US006467284B1

(12) United States Patent
Chen et al.

(10) Patent No.: US 6,467,284 B1
(45) Date of Patent: Oct. 22, 2002

(54) FROSTLESS HEAT PUMP HAVING THERMAL EXPANSION VALVES

(75) Inventors: Fang C. Chen, Knoxville, TN (US); Viung C. Mei, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 09/954,276

(22) Filed: Sep. 17, 2001

(51) Int. Cl.[7] ..... F25D 21/06
(52) U.S. Cl. ..... 62/156; 62/324.1
(58) Field of Search ..... 62/225, 324.1, 62/156

(56) References Cited

U.S. PATENT DOCUMENTS 4,467,613 A * 8/1984 Behr et al. ..... 62/115
5,142,879 A * 9/1992 Nakamura et al. ..... 62/160
5,669,224 A * 9/1997 Lenarduzzi ..... 417/42
5,678,761 A * 10/1997 Ikeda ..... 237/12.3 A
5,845,502 A * 12/1998 Chen et al. ..... 62/156
6,070,420 A * 6/2000 Biancardi et al. ..... 62/114

* cited by examiner

*Primary Examiner*—William E. Tapolcai
*Assistant Examiner*—Mohammad M. Ali
(74) *Attorney, Agent, or Firm*—Kirk A. Wilson

(57) ABSTRACT

A heat pump system having an operable relationship for transferring heat between an exterior atmosphere and an interior atmosphere via a fluid refrigerant and further having a compressor, an interior heat exchanger, an exterior heat exchanger, a heat pump reversing valve, an accumulator, a thermal expansion valve having a remote sensing bulb disposed in heat transferable contact with the refrigerant piping section between said accumulator and said reversing valve, an outdoor temperature sensor, and a first means for heating said remote sensing bulb in response to said outdoor temperature sensor thereby opening said thermal expansion valve to raise suction pressure in order to mitigate defrosting of said exterior heat exchanger wherein said heat pump continues to operate in a heating mode.

10 Claims, 3 Drawing Sheets

FROSTLESS HEAT PUMP HAVING THERMAL EXPANSION VALVES

FEDERAL RESEARCH STATEMENT

[Federal Research Statement Paragraph]This invention was made with Government support under contract no. DE-AC05-00OR22725 to UT-Battelle, LLC, awarded by the United States Department of Energy. The Government has certain rights in the invention.

BACKGROUND OF INVENTION

Heat pumps are well known and used for heating and/or cooling enclosures such as buildings and the like. A heat pump generally includes a heat exchanger fluid (usually called a refrigerant) that is circulated between an interior heat exchanger inside the enclosure and an exterior heat exchanger outside the enclosure.

During normal heating mode operation of a heat pump, the exterior (outdoor) heat exchanger thereof becomes colder than exterior ambient and absorbs heat into the refrigerant therefrom, and the interior (indoor) heat exchanger becomes warmer than interior ambient, transferring heat from the refrigerant into the indoor air. Thus, heat is "pumped" from a cooler exterior ambient into an interior ambient.

When the exterior temperature is near or below the freezing point of water, generally in the range of 30 to 40 degrees Fahrenheit, ice (frost) usually builds up on the exterior heat exchanger, greatly reducing the heat pump performance. Therefore, defrosting means are generally employed in heat pump systems. During these outdoor conditions, heat pumps using thermal expansion valves (TXV) instead of orifice-type expansion devices throttle the flow of refrigerant and prevent the heat pump from operating at optimal conditions for heat transfer.

The use of heat pump reversing defrost systems in heat pumps is well known. Such defrost systems are generally designed to melt ice build-up and evaporate water from the exterior heat exchanger in order to minimize deleterious effects of ice on the heat exchange process. Such defrost systems generally activate after a period of heat pump run time, and generally operate until the exterior heat exchanger is raised to a certain temperature to ensure removal of all or at least most ice and water.

During the defrost cycle, the heat pump is generally reversed. The exterior heat exchanger becomes warm, and the interior heat exchanger becomes cold. An auxiliary interior heater (usually an electrical resistance heater or a combustion heater) is energized in order to compensate for the heat absorbed during the defrost cycle by the interior heat exchanger.

In case the heat pump heating capacity cannot meet the house heating load requirement, conventional heat pumps energize the auxiliary resistance heating coil to meet the required load. This can cause a large interior temperature swing, and lowers the efficiency of operation.

SUMMARY OF INVENTION

The present invention relates to heat pumps having thermal expansion valves (TXV) and cyclic defrost systems, and more particularly to such heat pumps which employ a means for reducing the frequency, duration, and energy consumption of the defrost cycles by modulating the TXV during frost-prone outdoor conditions thereby increasing interior (indoor) thermal comfort.

In accordance with one aspect of the present invention, the foregoing and other objects are achieved by a heat pump system comprising, in an operable relationship for transferring heat between an exterior atmosphere and an interior atmosphere via a fluid refrigerant: a compressor; an interior heat exchanger; an exterior heat exchanger; a heat pump reversing valve; an accumulator; a thermal expansion valve having a remote sensing bulb disposed in heat transferable contact with the refrigerant piping section between said accumulator and said reversing valve; an outdoor temperature sensor; and a first means for heating said remote sensing bulb in response to said outdoor temperature sensor thereby opening said thermal expansion valve to raise suction pressure in order to mitigate defrosting of said exterior heat exchanger wherein said heat pump continues to operate in a heating mode.

In accordance with another aspect of the present invention, a method of heating an enclosure includes the steps of:

a. providing a heat pump system comprising, in an operable relationship for transferring heat between an exterior atmosphere and an interior atmosphere via a fluid refrigerant: a compressor; an interior heat exchanger; an exterior heat exchanger; a heat pump reversing valve; an accumulator; a thermal expansion valve having a remote sensing bulb; an outdoor temperature sensor; and a first means for heating said remote sensing bulb in response to said outdoor temperature sensor;

b. operating said heat pump in said heating mode;

c. intermittently operating a defrost mitigation cycle comprising maintaining said heat pump in heating mode while energizing said first means for heating said remote sensing bulb in response to said outdoor temperature sensor to fully open said thermal expansion valve and raise suction pressure in order to mitigate defrosting of said exterior heat exchanger.

Accordingly, it is an advantage of the present invention to provide a heat pump having new and improved defrost mitigation cycle system. It is another advantage of the present invention to provide a heat pump defrost mitigation cycle system which significantly reduces the frequency of heat pump reversing. It is a further advantage of the present invention to provide a heat pump defrost mitigation cycle system which significantly improves interior thermal comfort during the defrost cycle. It is a further advantage of the present invention to provide a heat pump defrost mitigation cycle system which significantly improves the reliability of the heat pump. It is a further advantage of the present invention provide a heat pump defrost mitigation cycle system which saves a significant amount of energy during operation of the heat pump.

Further and other objects of the present invention will become apparent from the description contained herein.

For a better understanding of the present invention, together with other and further objects, advantages and capabilities thereof, reference is made to the following disclosure and appended claims in connection with the above-described drawings.

DETAILED DESCRIPTION

The invention is a first means for heating a thermal expansion valve (TXV) remote sensing bulb in response to an outdoor temperature sensor thereby opening the TXV to raise suction pressure in order to mitigate defrosting of said exterior heat exchanger. The invention optionally includes a second means for heating the fluid refrigerant, via the accumulator; to eliminate cool interior air drafts during the heat pump defrost cycle. The invention reduces the frequency, duration, and energy consumption of heat pump defrost cycles by modulating the TXV during frost-prone outdoor conditions thereby increasing interior (indoor) thermal comfort. Such first and second means for heating is discrete from the heat pump circuit, separately controlled, and can be an electrical resistance heater, any type of combustion heater, or any structure adaptable for applying heat to the TXV remote sensing bulb or accumulator.

Figure 1:
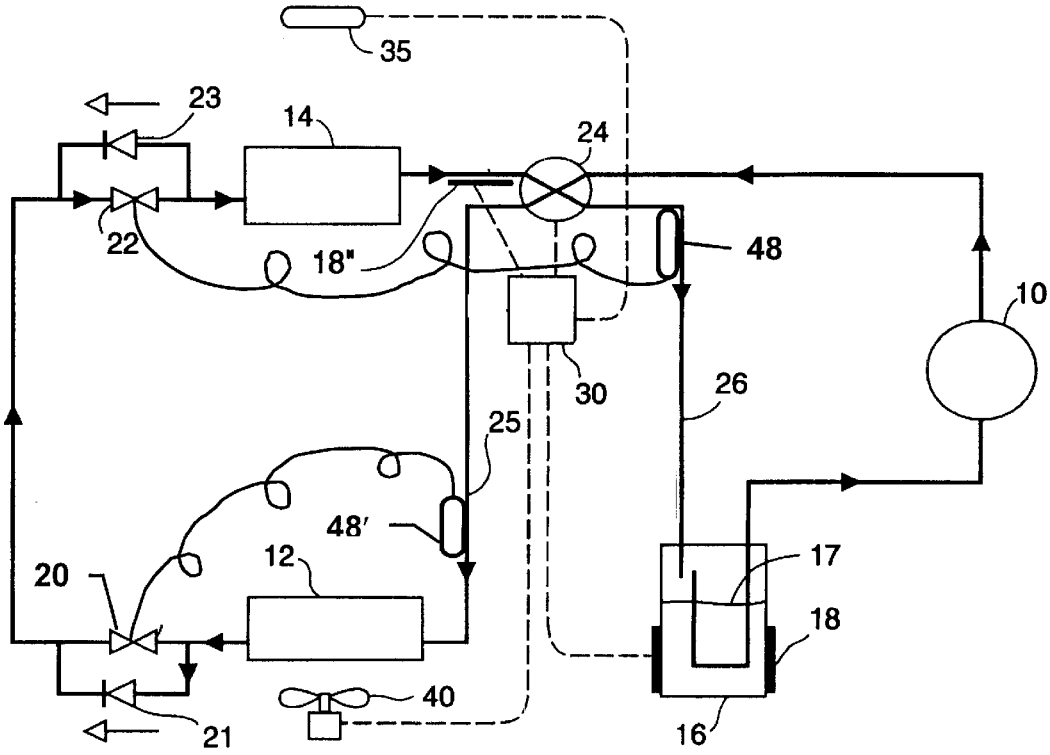
FIG. 1 is a schematic of a heat pump with a thermal expansion valve showing circulation in the heating mode.

FIG. 1 describes the essential heat exchange circuits in a heat pump system in accordance with the present invention, heating mode only. Shown therein are: compressor 10, interior heat exchanger 12, exterior heat exchanger 14, accumulator 16 containing liquid refrigerant 17, a first means for heating 18" the remote sensing bulb-48, outdoor temperature sensor 35, optional second means 18 for heating the accumulator 16, first and second expansion devices 20, 22, first and second check valves 21, 23, respectively, and heat pump reversing valve 24. Those skilled in the art will understand that complete heat pumps generally further comprise conventional power supplies, various control systems, and various other systems and sub-systems.

Figure 2:
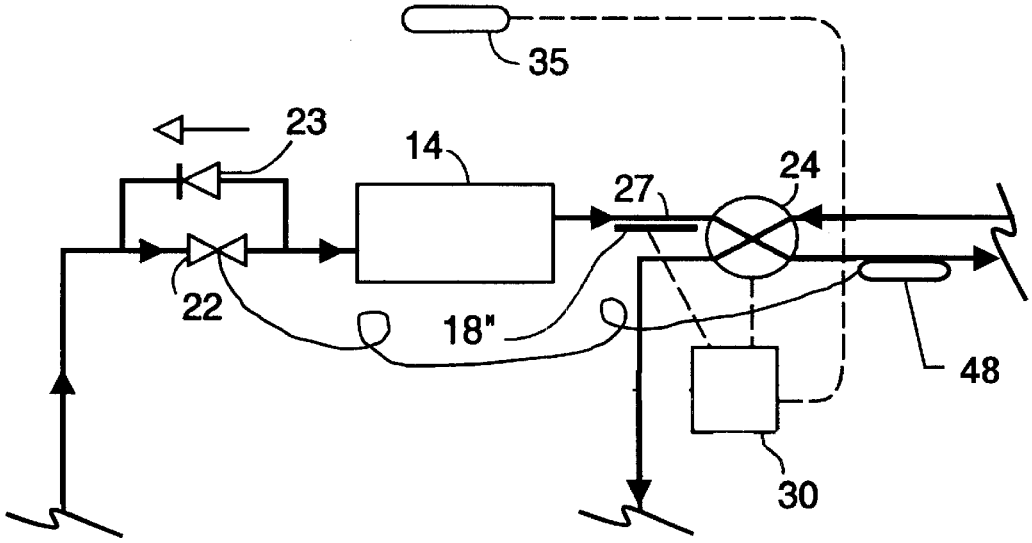
FIG. 2 is a schematic of the defrost mitigation components.

FIG. 2 shows the remote sensing bulb heater control. When the outdoor temperature sensor 35 senses the ambient temperature in the range of 30 to 40° F., the thermal switch inside the control box 30 will turn on the first means for heating 18", likely a small wattage (e.g., 6 Watts or so) electric resistance heater, to heat the remote sensing bulb 48 of the thermal expansion valve 22. The remote sensing bulb 48 will then open the TXV 22 wider than it will open normally. The added heat enables the TXV 22 to operate as if the suction temperature is higher than it actually is, and thus increases refrigerant 17 mass flow rate and evaporator coil 14 temperature for frost mitigation. When the ambient temperature is outside the 30 to 40° F. range, the TXV will function normally.

Experimental results have shown that the frost accumulation on the evaporator coil 14 will accelerate if heat is added to the remote sensing bulb 48 when the ambient temperature is below 30° F., because more surface area of the evaporator coil 14 is at temperature(s) lower than that of the ambient. When the ambient temperature is above 40° F., there is no need to add heat to the remote sensing bulb 48 since frost is not likely to form on the evaporator coil.

Figure 3:
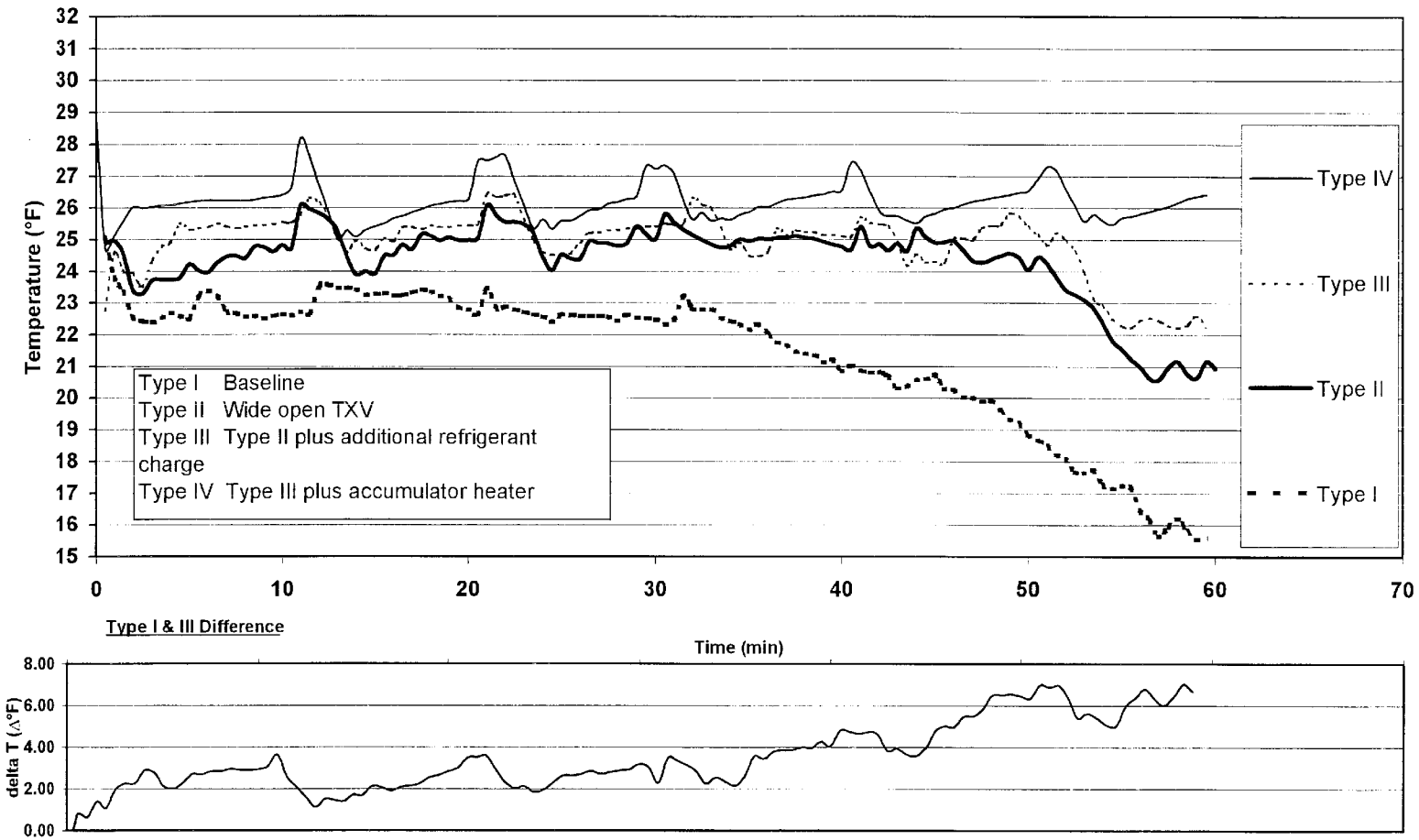
FIG. 3 is a graph of the evaporator coil temperature vs. time for an outdoor temperature of 31 deg. F.

FIG. 3 is a graph of the evaporator coil 14 temperatures vs. time at an exterior ambient temperature of 31° F. The Type I plot is a conventional heat pump operating in heating mode without activation of the defrost cycle. The Type II plot is a repeat of the Type I test with the thermal expansion valve fully open. The first means for heating 18" the TXV remote sensing bulb fully opens the TXV and thus would simulate the Type II operation. Type III is a repeat of the Type II test with additional refrigerant added. Type IV is a repeat of the Type III test with the optional second means for heating 18 activated to heat the refrigerant via the accumulator.

Figure 4:
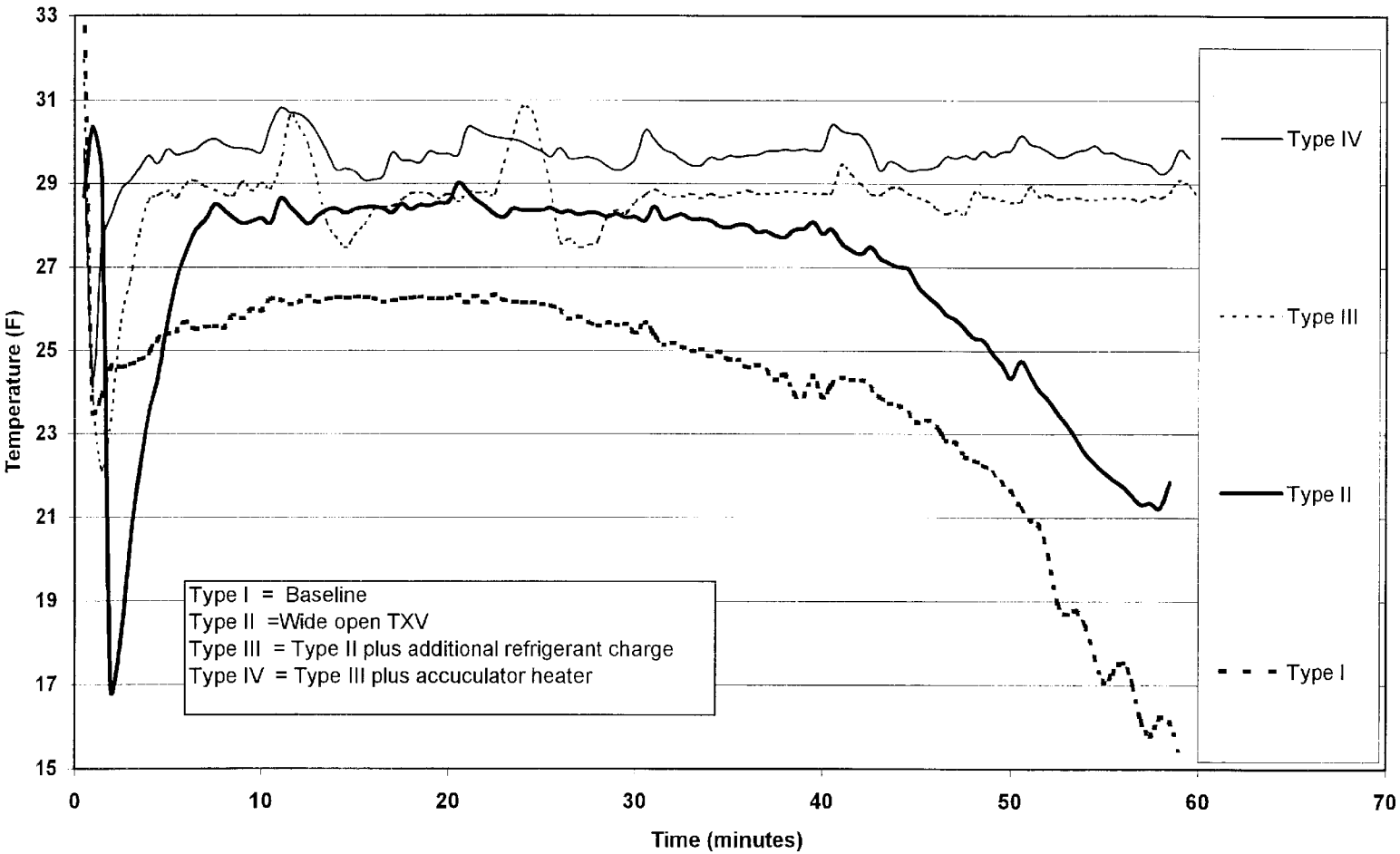
FIG. 4 is a graph of the evaporator suction temperature vs. time for an outdoor temperature of 35 deg. F.

FIG. 4 is a graph of the evaporator saturation temperature vs. time at an exterior ambient temperature of 35° F. The four test run conditions, or types, were identical to those in FIG. 3.

Heating Mode Heat Pump Operation:

Referring now to FIG. 1, heat pump reversing valve 24 is in the heating mode position so that the exterior heat exchanger 14 acts as an evaporator, and the interior heat exchanger 12 acts as a condenser. Cooling vapor refrigerant flows from the compressor 10 to the interior heat exchanger 12 to be condensed into hot high pressure liquid. Liquid flows through the first check valve 21 and thence through the second expansion device 22 to be evaporated in the exterior heat exchanger 14. The vapor refrigerant flows through the accumulator and returns to the compressor 10 to complete the cycle.

Heating Mode Defrosting Cycle Without Heat Pump Mode Reversing:

The invention significantly reduces the frequency of heat pump reversing for defrost. When the exterior heat exchanger 14 needs to be defrosted, as detected by the conventional heat pump control system, and the exterior ambient temperature is at least about 30° F. to 40° F., the desired defrosting effect is achieved via the invention without operating the heat pump reversing cycle.

The minimum exterior ambient temperature for practical operability of such a defrosting cycle depends on at least two factors: 1) the amount of heat applied by one or both heating means relative to the capacity of the heat pump, and 2) the climate conditions wherein the heat pump is to operate. For the TXV remote sensing bulb heater, also referred to as first heating means, a preselected exterior ambient temperature in the range of about 30° F. to 40° F. is suggested for residential and commercial heat pumps under normal conditions. For the optional accumulator heater, also referred to as second heating means, a preselected exterior ambient temperature is usually in the range of about 32° F. to 36° F. under normal temperate climate conditions. When the exterior ambient temperature is outside of either respective preselected exterior ambient temperature, the respective heating means is deenergized. When the exterior ambient temperature is below 30° F. and the heat pump control system calls for defrost, the conventional reversing valve defrost system is energized.

Irrespective of the need for defrosting, when the outdoor temperature sensor 35 senses the ambient temperature in the range of 30 to 40° F., the thermal switch inside the control box 30 will turn on the first means for heating 18", likely a small wattage (e.g., 6 Watts or so) electric resistance heater, to heat the remote sensing bulb 48 of the thermal expansion valve 22. The remote sensing bulb 48 will then open the TXV 22-wider than it will open normally. The added heat enables the TXV 22 to operate as if the suction temperature is higher than it actually is, and thus increases refrigerant 17 mass flow rate and evaporator coil 14 temperature for frost mitigation. When the ambient temperature is outside the 30 to 40° F. range, the TXV will function normally. The first means for heating 18" does not require the conventional heat pump defrost control system, typically time/temperature controlled, to be calling for defrost mode operation.

Optionally, if the conventional heat pump defrost control system calls for defrost and the exterior ambient temperature is in the range of 32° F. to 36° F., heat is applied by the second heating means 18, to the accumulator 16. Optional second heating means 18 can be an electrical resistance heater or any other conventional device that can be adapted for applying heat to the system as described hereinabove. Upon application of sufficient heat, the pressure downstream of the second expansion device 22 rises, and thus the temperature of the exterior heat exchanger 14 rises to a generally preselected temperature above 32° F. to effect defrosting thereof. Defrosting is thus accomplished while the heat pump is still in heating mode operation.

Since frost is most likely to build on the exterior heat exchanger 14 when the exterior ambient temperature is the range of about 30° F. to 40° F., the above described use of the invention at a minimum preselected temperature as described hereinabove provides a significant increase in over-all efficiency of the heat pump system.

EXAMPLE I

A two-ton air conditioning unit as described hereinabove, charged with R-22 refrigerant was used to test the invention as described hereinabove and the results are shown in FIGS. 3 and 4. Test results indicated that a 6 watt first heating means 18" input to the TXV remote sensing bulb 48 raised the evaporator coil temperature by 6° F. after 60 minutes of operation in a 31° F. ambient. After 60 minutes of operation in a 35° F. ambient with the 6 watt first heating means 18" activated, the refrigerant saturation temperature in the evaporator was 6° F. higher than that measured in conventional (baseline) heat pump operation.

Application of additional heat to the accumulator by the optional second heating means 18 further raises the exterior heat exchanger 14 temperature. The heat applied as described hereinabove is efficiently utilized as it is delivered to the house through the compressor 10. Because of the raised compressor suction pressure and temperature, the compressor 10 heating capacity increases. With the increased heat pump heating capacity and elimination of heat pump reversing and associated interior cool air draft, interior thermal comfort is improved. Because the frequency of defrost cycle heat pump reversing is reduced, heat pump reliability is improved.

Heating Mode Defrosting Cycle With Heat Pump Mode Reversing

When the exterior ambient temperature falls below 30° F., the heating capacity of the combined heating means may no longer be sufficient to efficiently raise the exterior heat exchanger 14 temperature above 32° F. In this situation, the heat pump control system causes conventional heat pump reversal during the defrost cycle. The refrigerant flow valve 24 is temporarily shifted to the cooling mode position so that the heat pump is operating in the cooling mode as described hereinabove. However, the invention is distinct from conventional heat pump reversing defrost cycles as is described hereinbelow.

Heat pump reversal can be simultaneous with energizing of both first heating means 18" and optional second heating means 18 or delayed a short period, whichever is more efficient for a particular application.

The heat required to evaporate the refrigerant is applied, preferably by the optional second heating means 18, to the accumulator 16. The interior blower 40 is preferably inactivated (turned off) during this type of defrost cycle.

Refrigerant boiling in the accumulator 16 causes the suction temperature and pressure to increase. The compressor heating capacity therefore increases immediately. This diminishes the need for use of the auxiliary heater except under conditions of very cold exterior ambient temperatures.

During the first two minutes of the defrost cycle, conventional heat pumps generally compress almost all refrigerant into the accumulator because of the heat pump reversing, which results in a "refrigerant-starved" compressor. The effectiveness of defrost cycle is delayed thereby. In contrast, the present invention boils liquid refrigerant in the accumulator almost immediately, which avoids "refrigerant-starvation" of the compressor, and thus accelerates the defrosting process.

A new liquid overair conditioning system has been proven to provide increased cooling capacity and coefficient of performance. The system is described in U.S. Pat. No. 5,245,833, issued on Sep. 21,1993, entitled "Liquid OverAir Conditioning System and Method", the entire disclosure of which is incorporated herein by reference. The liquid over-feed principle taught therein can be applied to a preferred embodiment of the heat pump set forth in the present invention. The refrigerant in the system should be charged so that liquid refrigerant is present in the accumulator-heat exchanger, in order to take advantage of the liquid over-feed principle.

The invention described hereinabove can be used in heat pumps with or without liquid over-feed feature. In the preferred liquid over-feed heat pump, the accumulator-heat exchanger 16 generally always contains liquid refrigerant. Adding heat into the accumulator-heat exchanger 16 boils off the refrigerant therein causing an increase in suction pressure.

For conventional (non-liquid over-feed) heat pumps, when frost begins to build on the exterior coil, refrigerant generally begins accumulating in the accumulator. During the defrost cycle, the heat input to the accumulator in accordance with the invention boils refrigerant in the accumulator, causing the suction pressure and temperature to increase, achieving essentially the same results as in the case of the liquid over-feed heat pump.

Some of the advantages of the present invention are:

1. Interior thermal comfort is improved. For conventional heat pump systems during the defrost cycle, even though the interior electric resistance heating coil is on, the temperature of air circulating through the interior air handling system (not illustrated) is still generally only about 65 to 70° F. Persons generally feel cold if such an air draft blows on them. With the present invention, there is no heat pump reversing while the exterior ambient is at least the preselected temperature. The heat pump continues to operate in heating mode while the frost on the exterior heat exchanger 14 coil is being melted. Simultaneously, the heating capacity of the heat pump is increased and the compressor efficiency is improved.

For lower exterior ambient temperatures, the heat pump is reversed as in conventional systems for defrosting. However, the electrical blower on the interior heat exchanger 12 (not illustrated) is usually inactive, eliminating interior cool air draft.

Moreover, in case the heat pump heating capacity is less than the required heating load, such as when the exterior ambient temperature is very low, a conventional heat pump system energizes the interior auxiliary resistance heating coil (not illustrated) to make up the heating capacity needed. Persons generally feel warm when the electric resistance coil is energized and then cold when the resistance coil is de-energized. With the present invention, the optional second heating means 18 provides sufficient heat to the accumulator 16 so that the compressor 10 efficiency is immediately increased and more heat is delivered indoors. This eliminates most large interior temperature swings and thus improves the interior thermal comfort.

2. Heat pump reliability is increased. It is known that heat pump reversing during defrost cycles imparts large mechanical and electrical stresses to the heat pump system. Because the frequency of defrost cycle heat pump reversing is drastically reduced, the heat pump, particularly the compressor, reliability is improved.

An example can be provided according to data in the ASHRAE Handbook-Fundamental, 1993, Chapter 28, Table 3, page 28.7 (American Society of Heating, Refrigerating, and Air Conditioning Engineers, Inc., 1791 Tullie Circle, N.E., Atlanta Ga. 30329). In the Nashville, Tennessee area, there are an average 924 (342+582) hours yearly wherein the exterior ambient temperature is in the range of 30° F. to 39° F., and an average 487 hours below 30° F. For a heat pump which defrosts once every 90 minutes, a total of 941 time cycle heat pump reverses are required for a conventional heat pump. The present invention eliminates 565 heat pump reverses (about 60%). Such drastic reduction of heat pump reversing improves the heat pump reliability.

3. Energy consumption is reduced. The interior auxiliary heater (not illustrated) is not energized during the defrost cycle because the function therein is replaced by combined heating means, 18" and optionally 18. Because the optional second heating means 18 is attached directly to the accumulator 16, the heat transfer between refrigerant and heating coil is direct, and much more efficient than that of interior coil, air and interior auxiliary heater. Moreover, because the interior fan is preferably inactive, the fan power is saved as well.

4. The time required for the defrost cycle is significantly shortened. During the defrosting cycle of a conventional heat pump, the heat pump is reversed and liquid refrigerant is pushed into the accumulator, causing "refrigerant starvation" as noted hereinabove. The invention overcomes this disadvantage by applying heat directly to the accumulator to effect immediate boiling of refrigerant in the accumulator 16. The defrost cycle is thus shortened.

The present invention can be implemented in new heat pumps and retrofitted into existing heat pumps with minimum capital cost, involving installation of a first heating means 18", optionally a second heating means 18, and defrost cycle controls (not illustrated) that can be easily be engineered for a particular application and installed therein by those skilled in the art.

The present invention can also be used on refrigeration systems which employ defrost cycles for faster and more energy efficient defrosting thereof.

What is claimed is:

1. A heat pump system comprising, in an operable relationship for transferring heat between an exterior atmosphere and an interior atmosphere via a fluid refrigerant: a compressor; an interior heat exchanger; an exterior heat exchanger; a heat pump reversing valve; an accumulator; a thermal expansion valve having a remote sensing bulb disposed in heat transferable contact with the refrigerant piping section between said accumulator and said reversing valve; an outdoor temperature sensor; a first means for heating said remote sensing bulb in response to said outdoor temperature sensor; and a means for controlling said first means for heating comprising a means for energizing said first means for heating when said outdoor temperature sensor is in the range of 30° F. to 40° F. thereby opening said thermal expansion valve to raise suction pressure in order to mitigate defrosting of said exterior heat exchanger wherein said heat pump continues to operate in a heating mode.

2. A heat pump system in accordance with claim 1 wherein said first means for heating said remote sensing bulb comprises an electric resistance element disposed in heat transferable contact with said remote sensing bulb.

3. A heat pump system in accordance with claim 1 further comprising a second means for heating the refrigerant in said accumulator in response to said outdoor temperature sensor.

4. A heat pump system in accordance with claim 3 wherein said second means for heating said accumulator comprises an electric resistance element disposed in heat transferable contact with said accumulator.

5. A heat pump system in accordance with claim 3 further comprising a means for controlling said second means for heating, said means for controlling comprising a means for energizing said second means for heating when said outdoor temperature sensor is in the range of 32° F. to 36° F.

6. A method of heating an enclosure comprising the steps of:

a. providing a heat pump system comprising, in an operable relationship for tansferring heat between an exterior atmosphere and an interior atmosphere via a fluid refrigerant: a compressor; an interior heat exchanger; an exterior heat exchanger; a heat pump reversing valve; an accumulator; a thermal expansion valve having a remote sensing bulb; an outdoor temperature sensor; and a first means for heating said remote sensing bulb in response to said outdoor temperature sensor;

b. operating said heat pump in said heating mode;

c. intermittently operating a defrost mitigation cycle comprising maintaining said heat pump in heating mode while energizing said first means for heating said remote sensing bulb in response to said outdoor temperature sensor, said mitigation cycle firer comprising a means for controlling said first means for heating, said means for controlling comprising a means for energizing said first means for heating when said outdoor temperature sensor is in the range of 30° F. to 40° F. to open said thermal expansion valve and raise suction pressure in order to mitigate defrosting of said exterior heat exchanger.

7. A method in accordance with claim 6 wherein said first means for heating said remote sensing bulb comprises an electric resistance element disposed in heat transferable contact with said remote sensing bulb.

8. A method in accordance with claim 6 further comprising a second means for heating the refrigerant in said accumulator in response to said outdoor temperature sensor.

9. A method in accordance with claim 8 wherein said second means for heating said accumulator comprises an electric resistance element disposed in heat transferable contact with said accumulator.

10. A method in accordance with claim 8 further comprising a means for controlling said second means for heating, said means for controlling comprising a means for energizing said second means for heating when said outdoor temperature sensor is in the range of 32° F. to 36° F.

* * * * *